US012662720B2

(12) United States Patent
Schober et al.

(10) Patent No.: US 12,662,720 B2
(45) Date of Patent: Jun. 23, 2026

(54) COPPER ALLOY, SEMIFINISHED PRODUCT AND ELECTRICAL CONNECTING ELEMENT COMPRISING A COPPER ALLOY

(71) Applicant: Wieland-Werke AG, Ulm (DE)

(72) Inventors: Patrick Schober, Heidenheim a.d. Brenz (DE); Julia Heilemann, Ulm (DE); Timo Allmendinger, Blaustein (DE); Matthias Nöhrer, Eisenstadt (AT)

(73) Assignee: WIELAND-WERKE AG, Ulm (DE)

( * ) Notice: Subject to any disclaimer, the term of this patent is extended or adjusted under 35 U.S.C. 154(b) by 386 days.

(21) Appl. No.: 18/431,083

(22) Filed: Feb. 2, 2024

(65) Prior Publication Data

US 2024/0263276 A1 Aug. 8, 2024

(30) Foreign Application Priority Data

Feb. 3, 2023 (DE) ..... 10 2023 000 334.4

(51) Int. Cl.
*C22C 9/02* (2006.01)

(52) U.S. Cl.
CPC ..... *C22C 9/02* (2013.01)

(58) Field of Classification Search
None
See application file for complete search history.

(56) References Cited

U.S. PATENT DOCUMENTS

| | | | | |
|---|---|---|---|---|
| 5,130,090 | A * | 7/1992 | Rissanen | B23K 35/302 228/262.61 |
| 5,865,910 | A * | 2/1999 | Bhargava | C22C 9/02 420/472 |
| 6,379,478 | B1 * | 4/2002 | Farquharson | C22C 9/06 420/472 |
| 10,982,302 | B2 * | 4/2021 | Weber | C22C 9/06 |
| 11,035,024 | B2 * | 6/2021 | Weber | C22C 9/02 |
| 11,655,524 | B2 * | 5/2023 | Yang | C22C 9/02 420/470 |

FOREIGN PATENT DOCUMENTS

| | | | | |
|---|---|---|---|---|
| CA | 2303164 | A1 * | 3/1999 | C22C 9/02 |
| CN | 105063418 | A * | 11/2015 | |
| EP | 3225707 | B1 | 10/2017 | |
| JP | 2006299409 | A * | 11/2006 | |
| JP | 2008231492 | A * | 10/2008 | |
| JP | 2013199699 | A | 10/2013 | |

(Continued)

OTHER PUBLICATIONS

Michael Bohsmann et al., Understanding Stress Relaxation, Copper and Copper Based Alloys in the Electronics Industry, Materials Science and Technology, Oct. 2008, pp. 41-47 (7 pages).

(Continued)

*Primary Examiner* — Devang R Patel
(74) *Attorney, Agent, or Firm* — FLYNN THIEL, P.C.

(57) ABSTRACT

The composition of a copper alloy is as follows: Sn: 3.0-6.5%; Ni: 0.30-0.70%; P: 0.15-0.40%; S: 0.10-0.40%; Zn: optionally up to 0.20%; Fe: optionally up to 0.50%; Mn: optionally up to 0.50%; Pb: optionally up to 0.25%, with the balance being copper and unavoidable impurities. The ratio of fraction of Ni to fraction of P is at least 1.1 and at most 2.8, and the alloy include nickel phosphides.

20 Claims, 1 Drawing Sheet

(56) References Cited

FOREIGN PATENT DOCUMENTS

| | | | | |
|---|---|---|---|---|
| JP | 5452778 | B1 * | 3/2014 | ..... C22C 9/00 |
| JP | 201914946 | A | 1/2019 | |
| WO | WO-2015027976 | A2 * | 3/2015 | ..... C22C 9/06 |

OTHER PUBLICATIONS

German Office Action issued in German Application No. 10 2023 000 334.4, issued Dec. 21, 2023 (10 pages).
European Search Report issued in corresponding European Application No. 24153569.9 with English translation of categories of cited documents, dated Jul. 5, 2024 (6 pages).

* cited by examiner

COPPER ALLOY, SEMIFINISHED PRODUCT AND ELECTRICAL CONNECTING ELEMENT COMPRISING A COPPER ALLOY

CROSS-REFERENCE TO RELATED APPLICATION

This claims priority from German Application No. 10 2023 000 334.4, filed Feb. 3, 2023, the disclosure of which is hereby incorporated by reference in its entirety.

TECHNICAL FIELD

The invention relates to a copper alloy, more particularly a wrought copper alloy, to a semifinished product in wire or rod form comprising a copper alloy, and to an electrical connecting element comprising a copper alloy.

BACKGROUND AND SUMMARY

In electrical engineering, for components which are to bring about an electrical connection, it is usual to use copper alloys. Such components are generally referred to as electrical connecting elements. Examples of such are plug-in connectors and electrical terminals. The components may be produced by machining from semifinished product in wire or rod form. Attaching such a component to an electrical lead, to a cable for example, is typically accomplished by a screw connection or by a crimp connection. To enable crimping, the material of the component must retain good cold-forming capacity even in the end state. The electrical connection in such a component is frequently realized by an external force that leads to an elastic deformation of the component, or of at least part of the component, and hence to a spring effect. By movement of lattice defects, such as dislocations, for example, and atoms of the alloy, an elastic deformation, present in the material as a consequence of an external stress, is transformed over time into a plastic deformation. As a result of this process, which is referred to as relaxation, the force maintained by the electrical connection subsides as time goes on. To ensure reliable electrical connection over the long term, therefore, the material of the component must be highly resistant to relaxation. Copper alloys for electrical connecting elements, particularly for plug-in connectors, must therefore combine high relaxation resistance and simultaneously high strength in particular with good cold-forming capacity, high machinability, and high electrical conductivity.

Plug-in connectors are presently manufactured from the alloy CuSn4Zn4Pb4. The high lead fraction of approximately 4% by weight makes the alloy highly machinable. Lead, however, is considered to be objectionable on grounds of health and environment, and so there is a need for a lead-reduced or lead-free alternative to CuSn4Zn4Pb4.

From the patent specification EP 3 225 707 B1 it is known that the lead-containing casting alloy CuSn5Zn5Pb2, which is used for manufacturing components for media-bearing gas or water conduits, may be replaced by a copper alloy containing 3.5% to 4.8% by weight Sn, 1.5% to 3.5% by weight Zn, 0.25% to 0.65% by weight S and 0.04% to 0.1% by weight P. The alloy may optionally contain up to 0.09% by weight of lead and up to 0.4% by weight of nickel. Because of the sulfur fraction, copper sulfides and zinc sulfides are formed in the alloy, and improve the machining properties of the casting alloy. However, the zinc sulfides are detrimental to the cold-forming capacity, as they lead to the formation of cracks. A reduction in the Zn fraction, while improving the cold-forming capacity, nevertheless makes the electrical conductivity and the relaxation resistance of the resultant alloy unsatisfactory, as they do not attain the same values as the CuSn4Zn4Pb4 alloy presently used for electrical connecting elements.

It is therefore an object of the invention to specify a copper alloy more particularly for use in electrical connecting elements. The alloy must display the following profile of properties: reduced fraction of Pb, high machinability, high strength, high electrical conductivity, and good relaxation resistance. In addition, the alloy must have good cold-forming capacity, to allow semifinished product in small dimensions to be manufactured at low cost and to enable crimping of the finished component manufactured from the alloy. The external dimensions of the semifinished product, its outer diameter for example, are typically 1.5 to 12 mm.

BRIEF DESCRIPTION OF THE DRAWINGS

Exemplary embodiments of the invention are explained in more detail with reference to the schematic drawings, in which.

DETAILED DESCRIPTION

Figure 1:
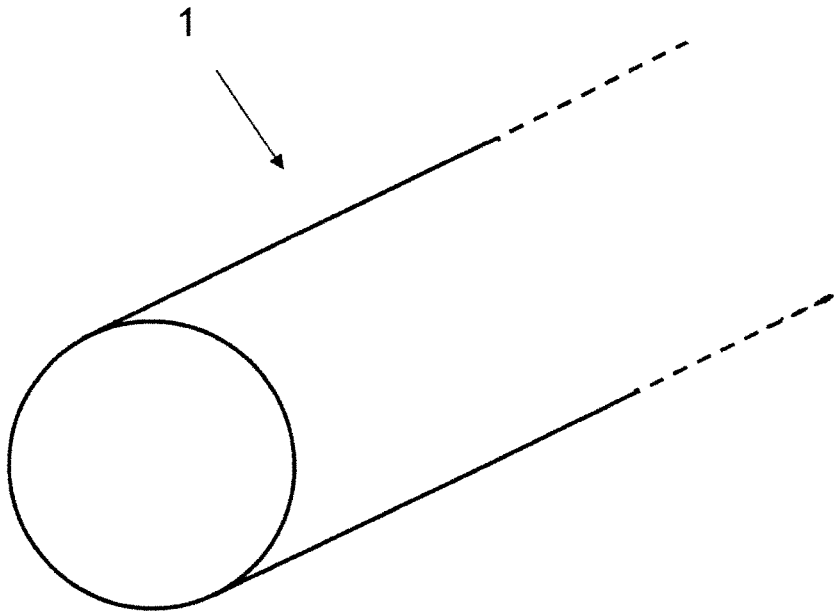
FIG. 1 illustrates a semifinished product in wire or rod form incorporating the copper alloy according to the invention.

The invention relates to a copper alloy with following composition in % by weight:

Sn: 3.0-6.5%,
Ni: 0.30-0.70%,
P: 0.15-0.40%,
S: 0.10-0.40%,
Zn: optionally up to 0.20%,
Fe: optionally up to 0.50%,
Mn: optionally up to 0.50%,
Pb: optionally up to 0.25%,
balance copper and unavoidable impurities,
wherein the ratio of fraction of Ni to fraction of P is at least 1.1 and at most 2.8 and wherein the alloy comprises nickel phosphides.

Copper-tin alloys have good spring properties and sliding properties and possess outstanding fatigue resistance. Tin also improves the strength and the hardness of the alloy and raises the corrosion resistance and the wear resistance. Increasing tin content is accompanied by increases in strength and hardness, while the electrical conductivity goes down. A favorable combination of these properties comes about if the tin fraction is at least 3.0% and at most 6.5% by weight. With a tin fraction of less than 3.0% by weight, the required strength cannot be achieved. With a tin fraction of more than 6.5% by weight, the desired conductivity can no longer be achieved. Additionally, with a tin fraction of more than 6.5% by weight, a brittle delta phase is formed and the hardness increases, while the deformability goes down.

The solubility of sulfur in copper is low. Sulfur leads to the formation of sulfides with the elements Cu, Zn, Fe and Mn. The sulfides act as chip breakers and so improve the machinability. Below 0.10% by weight, the sulfur fraction in the alloy is too low to improve machining. If the sulfur fraction is more than 0.40% by weight, the material becomes brittle and the cold-forming capacity is impaired. Precipitates of the $Cu_2S$ type produce only little reduction in the electrical conductivity.

Nickel has a positive effect on the electrical conductivity and the relaxation resistance in combination with phosphorus. It has surprisingly emerged that for copper-tin alloys having a phosphorus fraction in the range from 0.15% to 0.40% by weight, the addition of nickel in the range from 0.30% to 0.70% by weight improves the electrical conductivity and the relaxation resistance in comparison to nickel-free alloys. This effect is attributable to the formation of nickel phosphides. Nickel phosphides may have the compositions $Ni_2P$, $Ni_2P_2$ and $Ni_3P$. Surprisingly it has emerged that the formation of nickel phosphides is promoted if the ratio of fraction of Ni to fraction of P, abbreviated as Ni/P, is at least 1.1 and at most 2.8. Within this range, conditions for the formation of nickel phosphides, alongside the competing compounds of other elements with phosphorus, are favorable. The ratio Ni/P is preferably at least 1.4 and at most 2.5, more preferably at least 1.6 and at most 2.1. With nickel fractions less than 0.3% by weight, precipitates are not formed sufficiently to improve the relaxation resistance.

The nickel phosphides form predominantly globular precipitates which are uniformly finely divided in the microstructure. Because of their uniform division, they enable uniform forming of the material. The nickel phosphides are very small in size, meaning that, for a given total amount of nickel phosphides, the number of precipitates per unit volume is very large. Consequently, nickel phosphides may be particularly effective in their ability to fix—that is, hinder movement of—lattice defects such as grain boundaries and dislocations in the microstructure. As a result, the nickel phosphides not only contribute to a boost in the strength but also bring about a significant improvement in the relaxation resistance. This gives the alloy a particular advantage, since a boost in strength achieved through cold forming of the material typically results in a deterioration in the relaxation resistance: The cold deformation gives rise to dislocations which make the material stronger. If the material is exposed to elevated temperatures in use, the dislocations move (recovery processes) and the strength is consequently reduced. Finely divided nickel phosphide precipitates, which pin the dislocations fast, prohibit this dislocation movement. The material therefore remains strong and is resistant to relaxation.

The copper alloy may contain up to 0.20% by weight of zinc. Zinc forms zinc sulfides, which improve the machinability, but on the other hand adversely affect the cold-forming capacity. The alloy, therefore, must not contain more than 0.20% by weight of zinc.

The copper alloy may contain up to 0.50% by weight of iron. Iron has a lower solubility in the copper crystal lattice than nickel. On cooling of the melt, it therefore forms precipitates earlier and may in small quantities bring about grain refinement. Iron sulfides may promote the machining properties of the alloy. With phosphorus, iron may form iron phosphides, which have a similar effect on the relaxation as nickel phosphides. However, these phosphides have a melting point of 1350° C. and they therefore form even from the melt. This may lead to large precipitates, which are detrimental to the cold-forming capacity. The iron fraction in the alloy must therefore be not more than 0.50%, preferably not more than 0.24%, more preferably not more than 0.08% by weight.

The copper alloy may contain up to 0.50% by weight of manganese. Together with sulfur, manganese forms sulfides which promote chip breakage. Manganese therefore contributes to improving the machinability. If the manganese fraction exceeds 0.50% by weight, intermetallic phases may be formed which adversely affect the properties of the alloy. The manganese fraction in the alloy is preferably at most 0.10% by weight.

The copper alloy may contain up to 0.25% by weight of lead, preferably up to 0.09% by weight of lead. Lead has a positive effect on the machinability, but there are regulations limiting its fraction in the alloy.

The balance of the alloy comprises copper and unavoidable impurities. The fraction of the impurities is preferably less than 0.2% by weight, more preferably less than 0.1% by weight.

The alloy has outstanding properties in terms of cold-forming capacity, machinability, strength, electrical conductivity, and relaxation resistance. The low lead fraction renders it available for applications for which regulatory stipulations limit the fraction of lead. Even with a lead fraction of less than 0.03% by weight, the alloy can still be machined sufficiently well.

The special profile of properties of the alloy is achieved in particular through the specific selection of the fractions of the alloy elements Ni, P and S. The fractions of these elements are selected for preferential formation of copper sulfides and nickel phosphides. Copper sulfides improve the machinability, while nickel phosphides improve the relaxation resistance. Through the specific selection of the alloy composition, these two types of precipitate are successfully generated to the right extent.

To manufacture semifinished product, the alloy is melted and cast. Without hot forming, the cast format can be immediately cold-formed. In the formed state, the alloy is referred to as a wrought alloy. The alloy may be cast, for example, as cast wire with a diameter of 18 to 25 mm. The cast wire may be cold-formed by rolling or drawing. This may be followed by annealing in the temperature range between 550 and 700° C. for 2 to 7 hours to recrystallize the microstructure. If the annealing temperature is above 750° C., the electrical conductivity is reduced, since above this temperature nickel and phosphorus go back into solution. The sequence of forming and recrystallization annealing may be repeated until the semifinished product has the target dimensions. In this case, in each forming step, the degree of forming, defined as the relative decrease in cross-sectional area, is advantageously at least 15%. In particular, the sequence of forming steps may comprise at least one step having a degree of forming of at least 60%, more preferably at least 70%. The last operation in the manufacture of a semifinished product is typically a forming operation, especially a drawing operation.

In one embodiment of the invention, the ratio of fraction of P to fraction of S, abbreviated as P/S, may be at least 0.70. Nickel can enter into compounds both with phosphorus and with sulfur. With this embodiment, there is a minimum level of phosphorus present, relative to the fraction of sulfur, so that the conditions for the formation of nickel phosphides as against the formation of nickel sulfides are particularly favorable. Consequently, the alloy contains virtually no nickel sulfides. The ratio P/S may preferably be at least 0.80.

In another embodiment of the invention, the ratio of fraction of Ni to fraction of Fe, abbreviated as Ni/Fe, may be at least 1.8. Because of the minimum proportion of nickel selected in this embodiment, relative to the fraction of iron, nickel phosphides are formed preferentially, and fewer iron-containing precipitates. The ratio Ni/Fe may preferably be at least 2.8, more preferably at least 3.0.

In a further particular embodiment of the invention, the tin fraction may be 4.0% to 5.5% by weight. If the tin fraction is selected in this range, it remains predominantly dissolved in the matrix and leads to solid solution strengthening. Consequently, particularly favorable properties come about in terms of strength, electrical conductivity, corrosion resistance, and cold-forming capacity. Furthermore, elongation and necking exhibit a maximum within this range. The tin fraction may more preferably be 4.5% to 5.0% by weight.

In a further advantageous embodiment of the invention, the nickel fraction may be 0.35% to 0.65% by weight. If the nickel fraction is selected in this range, particularly favorable properties come about in terms of electrical conductivity, relaxation resistance, and cold-forming capacity. The Ni fraction may more preferably be 0.43% to 0.58% by weight.

In a further advantageous embodiment of the invention, the phosphorus fraction may be 0.20% to 0.35% by weight. If the phosphorus fraction is selected in this range, particularly favorable properties come about in terms of machinability, strength, and relaxation resistance. There is sufficient phosphorus in the alloy to form not only nickel phosphides but also copper phosphides. Copper phosphides improve the strength of the alloy, nickel phosphides improve the relaxation resistance and are more beneficial to the electrical conductivity than are copper phosphides. The phosphorus fraction may more preferably be 0.25% to 0.30% by weight.

In a further advantageous embodiment of the invention, the sulfur fraction may be 0.15% to 0.35% by weight. If sulfur is selected in this range, particularly favorable properties come about in terms of machinability and cold-forming capacity. The sulfur fraction is more preferably at most 0.30% by weight.

The copper alloy described above may take the form of a wrought copper alloy and be present more particularly as semifinished product in wire or rod form. More specifically, FIG. 1 illustrates a semifinished product 1 in wire or rod form incorporating a copper alloy according to the invention. The semifinished product 1 has a circular cross section. The length of the semifinished product 1 may be finite, which is typically the case for rods having a length of several meters, or it may be virtually infinite, which is typically the case for a wire that is wound into a coil, and may have a length of thousands of meters. The latter case is indicated in FIG. 1 by dashed lines.

Figure 2:
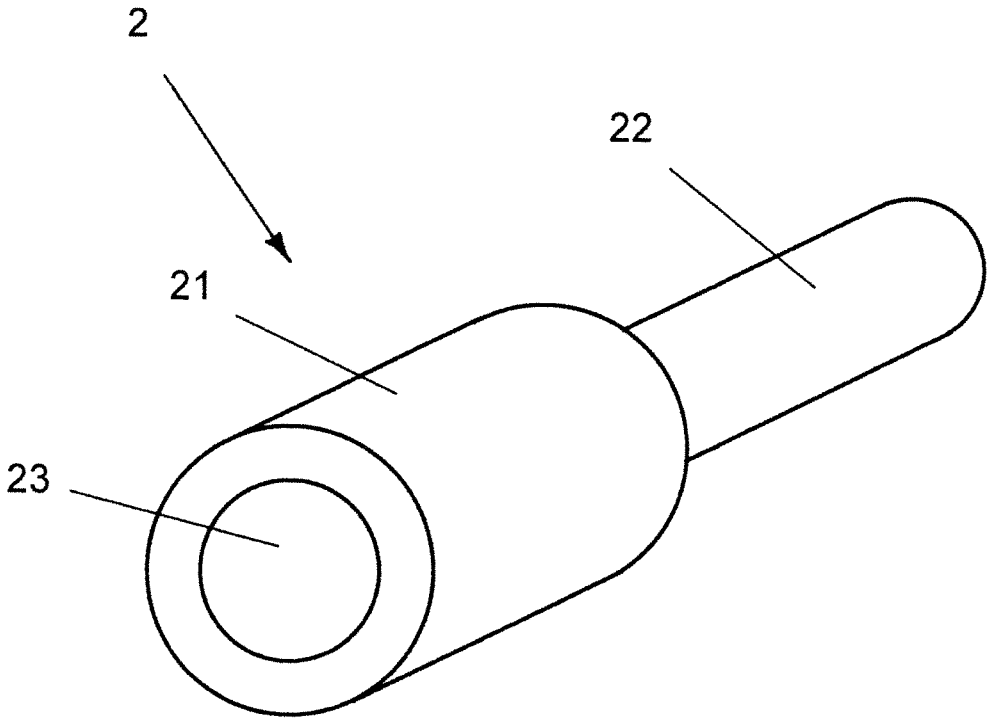
FIG. 2 illustrates an electrical connecting element incorporating the copper alloy according to the invention.

A further aspect of the invention relates to an electrical connecting element incorporating a copper alloy as described above. The invention relates more particularly to an electrical connecting element wherein the electrical connection is achieved by a spring effect of the connecting element or by a force effect, as for example by a screw connection and/or a crimp connection. Examples of such connecting elements are plug-in connectors and electrical terminals. The electrical connecting element may more particularly be produced by machining from a semifinished product in wire form or in rod form, incorporating a copper alloy as described above. More specifically, FIG. 2 depicts one embodiment of an electrical connecting element 2 incorporating a copper alloy according to the invention. The electrical connecting element 2 can be made from the semifinished product 1 depicted in FIG. 1 by cutting the wire or rod into the desired length and by machining. The electrical connecting element 2 includes a first section 21 and a second section 22, wherein the external diameter of the first section 21 is larger than the external diameter of the second section 22. The electrical connecting element 2 further includes a blind bore 23 located in the first section 21, which blind bore 23 is formed by drilling. The end of an electrical conductor (not shown in FIG. 2), e.g., a wire, can be inserted into the blind bore 23 and fixed to the electrical connecting element 2 by crimping the electrical connecting element 2 at the first section 21. The second section 22 of the electrical connecting element 2 can be inserted into a corresponding bore or cavity of a counterpart of the electrical connecting element 2 (not shown in FIG. 2). In this way, a plug-in connection is established.

The invention is elucidated in more detail using exemplary embodiments and comparative examples.

Table 1 documents the composition (in & by weight) of examples of the invention and of comparative examples. Samples 1 to 6 are examples of the invention. Samples 7 to 10, marked with *, are comparative examples, with sample 7 being the lead-containing reference alloy CuSn4Zn4Pb4. The table additionally contains information on the formability and electrical conductivity of the respective alloy. The symbol "+" in the Formability column denotes good formability, whereas the symbol "–" denotes poor formability.

TABLE 1

Composition of the samples, formability and conductivity

| Sample | Sn wt % | Ni wt % | P wt % | S wt % | Pb wt % | Zn wt % | Fe wt % | Mn wt % | Cu and impurities wt % | Ni/P | Formability | Elec. conductivity in S · m/mm$^2$ |
|---|---|---|---|---|---|---|---|---|---|---|---|---|
| 1 | 4.51 | 0.501 | 0.260 | 0.197 | 0.0003 | 0.010 | 0.010 | 0.003 | balance | 1.92 | + | 8.54 |
| 2 | 6.24 | 0.628 | 0.235 | 0.120 | 0.232 | 0.078 | 0.076 | 0.419 | balance | 2.67 | + | 8.37 |
| 3 | 4.12 | 0.569 | 0.374 | 0.332 | 0.025 | 0.189 | 0.467 | 0.048 | balance | 1.52 | + | 9.03 |
| 4 | 5.35 | 0.678 | 0.284 | 0.372 | 0.072 | 0.134 | 0.224 | 0.087 | balance | 2.39 | + | 8.41 |
| 5 | 3.37 | 0.393 | 0.342 | 0.287 | 0.088 | 0.049 | 0.043 | 0.069 | balance | 1.15 | + | 8.87 |
| 6 | 4.88 | 0.339 | 0.194 | 0.156 | 0.115 | 0.036 | 0.178 | 0.022 | balance | 1.75 | + | 8.62 |
| 7* | 3.71 | 0.10 | 0.20 | 0.001 | 3.48 | 3.83 | 0.004 | 0.001 | balance | 0.47 | + | 9.18 |
| 8* | 4.48 | 0.01 | 0.05 | 0.46 | 0.00 | 2.40 | 0.008 | 0.003 | balance | 0.10 | – | 10.9 |
| 9* | 3.65 | 0.01 | 0.05 | <0.002 | 0.0070 | 7.67 | 0.14 | 0.001 | balance | 0.29 | – | 11.2 |
| 10* | 4.50 | 0.01 | 0.28 | 0.23 | 0.0003 | 0.014 | 0.01 | 0.003 | balance | 0.02 | + | 7.61 |

The alloys were melted and cast as wire with a diameter of 20 mm. They were subsequently cold-formed in a plurality of steps to an outer diameter of 1.5 mm. The degree of forming, defined as the relative decrease in cross-sectional area, was at least 18% in each forming step. However, degrees of forming of more than 70% were also reached in a single forming step, especially in the last forming step. Between two forming steps, the samples were annealed at approximately 650° C. The nickel-containing alloys of samples 1 to 6 and also the nickel-free alloy of sample 10 were readily formable, like the reference alloy of sample 7. Samples 8 (CuSn4Zn2PS) and 9 (CuSn4Zn8FeP) had only very limited forming capacity, with cracks already occurring in the material at a diameter of 15 mm.

The annealed-state electrical conductivity was determined on samples having an outer diameter of approximately 15 mm. Reference alloy 7 has an electrical conductivity of approximately 9.2 S·m/mm$^2$, corresponding to 16% IACS. The electrical conductivity of the nickel-containing alloys of samples 1 to 6 is between 8.4 and 9.0 S·m/mm$^2$, corresponding to approximately 15% IACS. The conductivity of these alloys is therefore only just below the conductivity of reference alloy 7. The nickel-free alloy of sample 10 has a lower electrical conductivity of just 7.6 S·m/mm$^2$ (approximately 13% IACS). Samples 8 and 9, while having a relatively high conductivity at approximately 19% IACS, are nevertheless not further contemplated, owing to their poor formability.

To characterize the relaxation, wires with a diameter of 4 mm, fabricated from samples 1 (CuSn5NiSP), 7 (CuSn4Zn4Pb4) and 10 (CuSn5PS), had their decrease in stress $\Delta\sigma$ measured as a function of time, at different temperatures, for two respective strength states, using the ring method. The test times and the temperatures were selected so that the Larson-Miller parameter covers the 7 to 11 range. Details of the measurement method can be found in the paper "Understanding Stress Relaxation" by M. Bohsmann and S. Gross, in Materials Science and Technology, 2008, October, pages 41 to 47.

TABLE 2

Results of the stress relaxation tests

| | | Relative stress decrease $\Delta\sigma$ in % at temperature in ° C. | | | | | | |
|---|---|---|---|---|---|---|---|---|
| Sample | $R_m$ MPa | 50° C. | 70° C. | 95° C. | 120° C. | 140° C. | 185° C. | 230° C. |
| 1 | 796 | 0.72 | 2.9 | 5.18 | 12.95 | 20.23 | 38.86 | 63.11 |
| 7 | 765 | 0.66 | 2.24 | 7.56 | 13.46 | 18.48 | 38.72 | 68.84 |
| 10 | 795 | 0.78 | 2.09 | 9.21 | 19.36 | 25.47 | 51.17 | 76.98 |
| 1 | 843 | 0.83 | 3.64 | 8.35 | 15.62 | 23.44 | 40.52 | 66.49 |
| 7 | 834 | 2.53 | 4.55 | 8.51 | 14.77 | 22.04 | 38.4 | 60.72 |
| 10 | 817 | 0.86 | 3.53 | 9.35 | 19.83 | 28.83 | 51.46 | 74.61 |

Table 2 shows the results of the studies. It reports the relative decrease in stress $\Delta\sigma$ of the material, relative to the starting value, at room temperature. The values documented in the top three lines were ascertained on samples 1, 7 and 10 for a strength state characterized by a tensile strength of approximately 780 MPa. The values documented in the bottom three lines were ascertained on samples 1, 7 and 10 for a strength state characterized by a tensile strength of approximately 830 MPa. The lower the measured decrease in the stress, the better the relaxation resistance of the material.

The nickel-containing alloy of sample 1 exhibits a relaxation resistance, for both strength states studied, which is approximately at the level of the lead-containing reference alloy of sample 7. Conversely, for both strength states studied, the nickel-free alloy of sample 10 exhibits a much greater decrease in the stress, at temperatures above 90° C., than samples 1 and 7. Comparison of samples 1 and 10 therefore demonstrates that the element nickel in the alloy significantly improves the relaxation resistance. The cause of this is nickel phosphides present in finely divided form in the microstructure of the material.

The studies show that the nickel- and phosphorus-containing copper alloy described displays a profile of properties largely identical to the profile of properties of the lead-containing alloy CuSn4Zn4Pb4. It is therefore possible to replace the lead-containing alloy CuSn4Zn4Pb4 by an alloy whose lead content is at an unobjectionable level.

The invention claimed is:

1. A copper alloy having a composition consisting of:
Sn: 3.0-6.5% by weight,
Ni: 0.30-0.70% by weight,
P: 0.15-0.40% by weight,
S: 0.10-0.40% by weight,
Zn: optionally up to 0.20% by weight,
Fe: optionally up to 0.50% by weight,
Mn: optionally up to 0.50% by weight,
Pb: optionally up to 0.25% by weight,
the balance being copper and unavoidable impurities,
wherein the ratio of fraction of Ni to fraction of P is at least 1.1 and at most 2.8 and wherein the alloy comprises nickel phosphides.

2. The copper alloy according to claim 1, wherein the ratio of fraction of P to fraction of S is at least 0.70.

3. The copper alloy according to claim 1, wherein the ratio of fraction of Ni to fraction of Fe is at least 1.8.

4. The copper alloy according to claim 1, wherein the Sn fraction is 4.0% to 5.5% by weight.

5. The copper alloy according to claim 1, wherein the Ni fraction is 0.35% to 0.65% by weight.

6. The copper alloy according to claim 1, wherein the P fraction is 0.20% to 0.35% by weight.

7. The copper alloy according to claim 1, wherein the S fraction is 0.15% to 0.35% by weight.

8. A semifinished product in wire or rod form comprising a copper alloy according to claim 1.

9. An electrical connecting element comprising a copper alloy according to claim 1.

10. The copper alloy according to claim 2, wherein the ratio of fraction of Ni to fraction of Fe is at least 1.8.

11. The copper alloy according to claim 2, wherein the Sn fraction is 4.0% to 5.5% by weight.

12. The copper alloy according to claim 3, wherein the Sn fraction is 4.0% to 5.5% by weight.

13. The copper alloy according to claim 2, wherein the Ni fraction is 0.35% to 0.65% by weight.

14. The copper alloy according to claim 3, wherein the Ni fraction is 0.35% to 0.65% by weight.

15. The copper alloy according to claim 4, wherein the Ni fraction is 0.35% to 0.65% by weight.

16. The copper alloy according to claim 2, wherein the P fraction is 0.20% to 0.35% by weight.

17. The copper alloy according to claim 3, wherein the P fraction is 0.20% to 0.35% by weight.

18. The copper alloy according to claim 4, wherein the P fraction is 0.20% to 0.35% by weight.

19. The copper alloy according to claim 5, wherein the P fraction is 0.20% to 0.35% by weight.

20. The copper alloy according to claim 2, wherein the S fraction is 0.15% to 0.35% by weight.

* * * * *